US007744080B2

(12) United States Patent
Shimoohsako

(10) Patent No.: US 7,744,080 B2
(45) Date of Patent: Jun. 29, 2010

(54) SHEET FEED DEVICE AND IMAGE FORMING APPARATUS

(75) Inventor: Masataka Shimoohsako, Nishitokyo (JP)

(73) Assignee: Ricoh Company, Ltd., Tokyo (JP)

( * ) Notice: Subject to any disclaimer, the term of this patent is extended or adjusted under 35 U.S.C. 154(b) by 3 days.

(21) Appl. No.: 12/232,295

(22) Filed: Sep. 15, 2008

(65) Prior Publication Data

US 2009/0096154 A1 Apr. 16, 2009

(30) Foreign Application Priority Data

Sep. 14, 2007 (JP) ..... 2007-239715

(51) Int. Cl.
*B65H 3/14* (2006.01)

(52) U.S. Cl. ..... 271/97; 271/98

(58) Field of Classification Search ..... 271/97, 271/98, 114, 10.11, 10.02, 11
See application file for complete search history.

(56) References Cited

U.S. PATENT DOCUMENTS

| | | | | |
|---|---|---|---|---|
| 6,186,492 | B1 * | 2/2001 | Dechau et al. | 271/30.1 |
| 6,718,145 | B2 | 4/2004 | Ohta et al. | |
| 6,942,208 | B2 * | 9/2005 | Okazaki et al. | 271/97 |
| 6,996,349 | B2 | 2/2006 | Ohta et al. | |
| 7,140,606 | B2 * | 11/2006 | Suga et al. | 271/97 |
| 7,237,771 | B2 * | 7/2007 | Lang et al. | 271/9.01 |
| 7,419,152 | B2 * | 9/2008 | Adachi | 271/97 |
| 7,500,665 | B2 * | 3/2009 | Lamendola et al. | 271/97 |
| 2002/0186979 | A1 | 12/2002 | Ohta et al. | |
| 2004/0146310 | A1 | 7/2004 | Ohta et al. | |
| 2004/0178557 | A1 * | 9/2004 | Okazaki et al. | 271/97 |
| 2005/0285326 | A1 * | 12/2005 | Uji et al. | 271/97 |
| 2006/0175746 | A1 * | 8/2006 | Adachi | 271/97 |
| 2006/0180984 | A1 * | 8/2006 | Suga et al. | 271/97 |
| 2007/0045932 | A1 * | 3/2007 | Koga et al. | 271/97 |
| 2007/0069446 | A1 * | 3/2007 | Lamendola et al. | 271/98 |
| 2007/0080491 | A1 * | 4/2007 | Suga et al. | 271/97 |
| 2007/0138416 | A1 | 6/2007 | Ohta et al. | |
| 2007/0228639 | A1 * | 10/2007 | Matsumoto et al. | 271/97 |

(Continued)

FOREIGN PATENT DOCUMENTS

| | | |
|---|---|---|
| JP | 2890674 | 2/1999 |

(Continued)

OTHER PUBLICATIONS

Abstract for JP 2001-088964 published Apr. 3, 2001.

(Continued)

*Primary Examiner*—Kaitlin S Joerger
(74) *Attorney, Agent, or Firm*—Harness, Dickey & Pierce, P.L.C.

(57) ABSTRACT

A sheet feed device includes a sheet storage portion, a pick-up unit, a sheet-feed separation unit, and an air blower. The sheet storage portion stores a stack of sheets. The pick-up unit picks up the sheets stored in the sheet storage portion. The sheet-feed separation unit separates and feeds one by one the sheets picked up by the pick-up unit. The air blower blows air against a lateral side face of the stack of sheets stored in the sheet storage portion. The pick-up unit picks up the sheets while the air blower blows air and before the sheet-feed separation unit starts to operate.

20 Claims, 11 Drawing Sheets

U.S. PATENT DOCUMENTS

2008/0217838 A1* 9/2008 Roberts et al. ..... 271/97

FOREIGN PATENT DOCUMENTS

| | | |
|---|---|---|
| JP | 11-157686 | 6/1999 |
| JP | 2000-344358 | 12/2000 |
| JP | 2000-351462 | 12/2000 |
| JP | 2002-104679 | 4/2002 |
| JP | 2003-176051 | 6/2003 |
| JP | 3940876 | 4/2007 |

OTHER PUBLICATIONS

Abstract for JP 04-023747 published Jan. 28, 1992.

* cited by examiner

| FIG. 5A |
| --- |
| FIG. 5B |

| FIG. 6A |
| --- |
| FIG. 6B |

| FIG. 7A |
| --- |
| FIG. 7B |

SHEET FEED DEVICE AND IMAGE FORMING APPARATUS

CROSS-REFERENCE TO RELATED APPLICATIONS

The present patent application claims priority pursuant to 35 U.S.C. §119 from Japanese Patent Application No. 2007-239715, filed on Sep. 14, 2007 in the Japan Patent Office, the entire contents of which are hereby incorporated herein by reference.

BACKGROUND OF THE INVENTION

1. Field of the Invention

The present invention relates to an image forming apparatus, such as a copying machine and a printer, and more specifically, to an air-blow sheet feed device used therein.

2. Description of the Background

Image forming apparatuses are used as copiers, printers, facsimile machines, and multi-functional devices combining several of the foregoing capabilities. For such image forming apparatuses or sheet conveying devices used therein, various sheet feed devices using air separation instead of frictional separation have been proposed to enhance sheet-separation performance with various different types of sheets.

For example, a conventional sheet feed device has a sheet press member that enables separation air blown from one side of the device to pass through the device to the opposite side.

Another conventional sheet feed device has a member for opening and closing an air passage near a point at which an air knife contacts loaded sheets, thus allowing the thickness of the air knife contacting the loaded sheets to be sequentially changed.

In still another conventional sheet feed device, blowing air is directed downward to an upper face of a sheet.

In further still another conventional sheet feed device, the shape of an air-blow nozzle is selectable or replaceable in accordance with sheet characteristics to separate various types of sheets, which range from thin paper to cardboard, having different properties.

However, such sheet-feed separating systems using air flow may depend largely on factors associated with sheet shape, such as elasticity and deflection. Although various improvements in nozzle shape or air blowing angle have been attempted, it is difficult to provide a quantitatively assured separation quality since its manufacturing process depends largely on manual operations.

When a compressor is used in such sheet-feed device, increases in power consumption and noise may need to be improved.

Furthermore, the adhesion force between sheets cannot be defined by only the friction coefficient between sheets. For example, the sheet adhesion force falls into a mechanical adhesion force due to burrs generated in cutting, a tacky adhesion force generated by changes in surface coat layers due to changes in temperature and humidity, and an electrostatic adhesion force as generated in an OHP (overhead projector) sheet.

Then, as the capacity of a sheet feed tray in such sheet feed device is increased, lower sheets receive more weight of upper sheets. As a result, the adhesion force between sheets is increased, thereby lowering the sheet-feed separation performance.

Other conventional sheet-feed mechanisms have been proposed in which a member for assisting the sheet separation function of a sheet-feed separation unit with airflow is separately provided independent of the sheet-feed separation unit. Although various improvements have been attempted on such mechanisms, a recent increase in sheet types may pose challenges for the reliability of such sheet-feed mechanisms.

SUMMARY OF THE INVENTION

At least one of example embodiments of the present invention provides a sheet feed device capable of feeding sheets with adhesion force between the sheets reduced, thereby obtaining excellent sheet-feed separation performance and sheet conveyance quality and an image forming apparatus using the sheet feed device.

In one example embodiment of the present invention, a sheet feed device includes a sheet storage portion, a pick-up unit, a sheet-feed separation unit, and an air blower. The sheet storage portion stores a stack of sheets. The pick-up unit picks up the sheets stored in the sheet storage portion. The sheet-feed separation unit separates and feeds one by one the sheets picked up by the pick-up unit. The air blower blows air against a lateral side face of the stack of sheets stored in the sheet storage portion. The pick-up unit picks up the sheets while the air blower blows air and before the sheet-feed separation unit starts to operate.

In another example embodiment of the present invention, an image forming apparatus includes a sheet feed device. The sheet feed device includes a sheet storage portion, a pick-up unit, a sheet-feed separation unit, and an air blower. The sheet storage portion stores a stack of sheets. The pick-up unit picks up the sheets stored in the sheet storage portion. The sheet-feed separation unit separates and feeds one by one the sheets picked up by the pick-up unit. The air blower blows air against a lateral side face of the stack of sheets stored in the sheet storage portion. The pick-up unit picks up the sheets while the air blower blows air and before the sheet-feed separation unit starts to operate.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
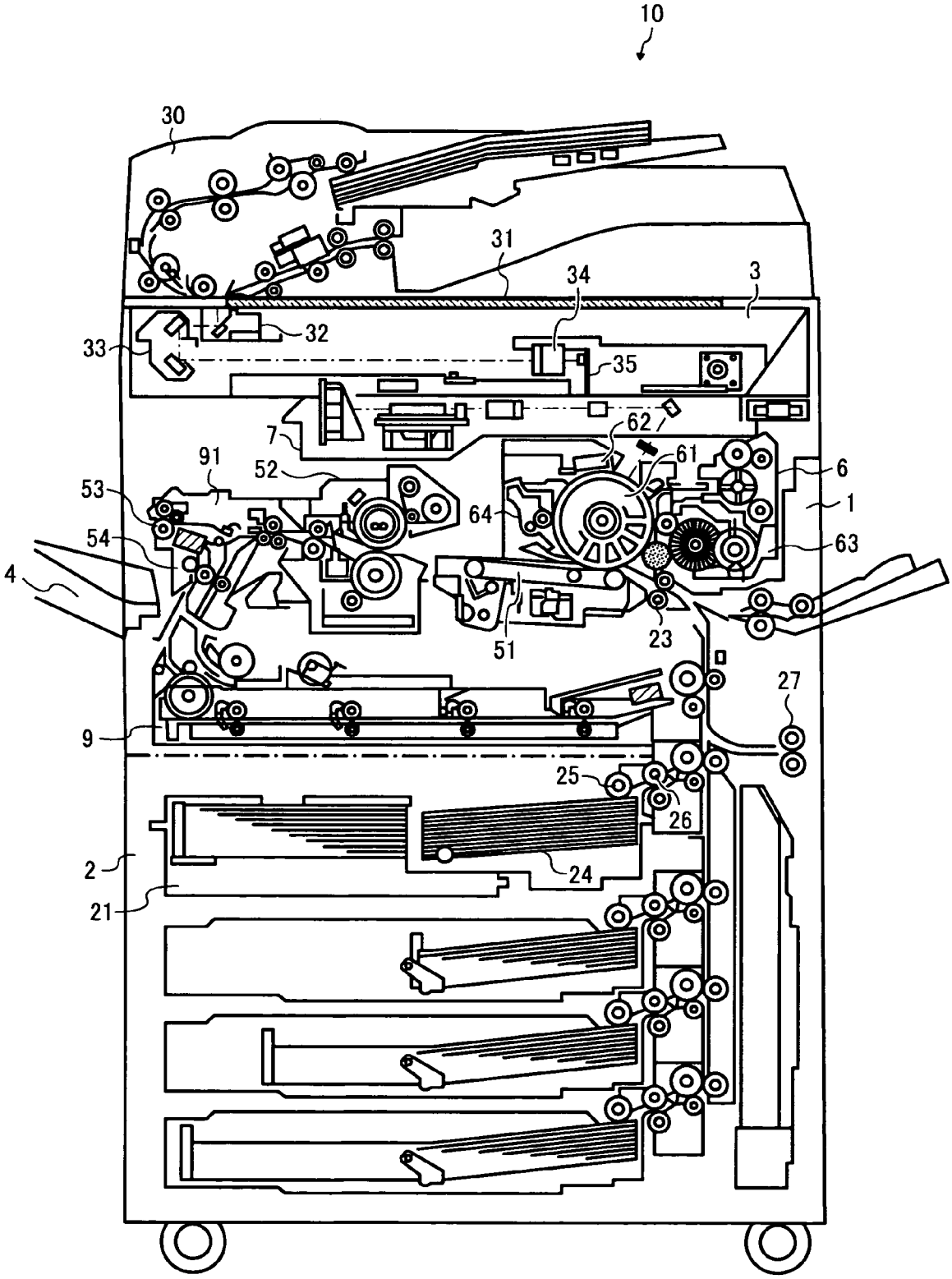
FIG. 1 is a schematic sectional view of a copying machine illustrated as an example of an image forming apparatus according to an example embodiment of the present invention.

The accompanying drawings are intended to depict example embodiments of the present disclosure and should not be interpreted to limit the scope thereof. The accompanying drawings are not to be considered as drawn to scale unless explicitly noted.

DETAILED DESCRIPTION OF EXAMPLE EMBODIMENTS

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Below, example embodiments of the present disclosure are described with reference to the attached drawings.

FIG. 1 is a schematic sectional view of a copying machine illustrated as an example of an image forming apparatus 10 according to an example embodiment of the present invention. In FIG. 1, the image forming apparatus 10 includes an image forming section 1 in a middle portion thereof and a sheet feed section 2 below the image forming section 1. In FIG. 1, the sheet feed section 2 includes sheet feed trays 21 at multiple stages. Above the image forming section 1 is disposed a reading section 3 to read a document. On the left side of the image forming section 1 in FIG. 1, an ejected-sheet stack section 4 is disposed to stack printed sheets.

The image forming section 1 includes an imaging unit 6 and a photosensitive drum 61 serving as an image carrier. Around the photosensitive drum 61 are disposed a charging unit 62 to charge the surface of the photosensitive drum 61, a development unit 63 to develop an electrostatic latent image formed on the surface of the photosensitive drum 61 into a visualized toner image, and a cleaning unit 64 to remove and collect residual toner remaining on the photosensitive drum 61. Above the imaging unit 6 is disposed an exposure unit 7 to irradiate a surface of the photosensitive drum 61 with a laser beam in accordance with image information. Below the photosensitive drum 61 is disposed a transfer unit 51 to transfer a toner image formed on the photosensitive drum 61 onto a sheet. At one lateral side of the transfer unit 51 is disposed a fixing unit 52 to fix the toner image on the sheet. The fixing unit 52 applies heat and pressure to the toner transferred on the sheet while the sheet is being passed through a nip between a pair of rollers. The sheet having passed through the fixing unit 52 is ejected by ejection rollers 53 to the ejected-sheet stack section 4.

In the sheet feed section 2, unused sheets are stored in each sheet feed tray 21. A pivotably supported bottom plate 24 raises the sheets to a position where a pickup roller 25 contacts an uppermost sheet of the sheets. As sheet feed rollers 26 are rotated, the uppermost sheet is conveyed from the relevant sheet-feed tray 21 to registration rollers 23.

The registration rollers 23 temporarily stops the conveyance of the sheet and then restarts the rotation at such a timing that the leading edge of the sheet is located at a predetermined position relative to the toner image on the surface of the photosensitive drum 61.

The reading section 3 includes reading carriages 32 and 33 that reciprocate to read and scan a document placed on a contact glass 31. The reading carriages 32 and 33 include mirrors and a light source for illuminating the document. The image information scanned by the reading carriages 32 and 33 is read as image signals by a CCD (charge coupled device) 35 disposed at the rear side of a lens 34. The image signals are digitized by an image processing unit. In the image forming section 1, a laser diode (LD) in the exposure unit 7 emits light in accordance with the image signals processed by the image processing unit, thereby forming the electrostatic latent image on the surface of the photosensitive drum 61. The light signal emitted from the LD travels to the photosensitive drum via a polygon mirror and lenses. Above the reading section 3 is disposed an automatic document feeder 30 to automatically feed documents.

In the case of duplex printing, the conveyance path of the sheet subjected to the fixing process is switched at a branching section 91. The sheet is reversed by a duplex reverse unit 9 and conveyed to the registration rollers 23. The skew of the sheet is corrected by the registration rollers 23 and an image forming operation on a reverse side of the sheet is started.

According to this example embodiment, in addition to a so-called digital copying function in which a document is read and digitized to be copied on a sheet as described above, the image forming apparatus 10 may have multiple functions, such as a facsimile function for transmitting and receiving image information on a document to and from a remote place through a control unit, and a so-called printer function for printing image information processed by a computer onto a sheet. The copying function may be set by an operator through an operation unit. Images formed using any of the above-described functions may be ejected to the ejected-sheet stack section 4.

When the sheets are reversed through the duplex reverse unit 9 and ejected from the ejection rollers 53 through reverse ejection rollers 54, the sheets are stacked on the ejected-sheet stack section 4 with the front side thereof down. Accordingly, even when the documents are processed from a first page in any of the copying, facsimile, and printer functions, the stacked sheets can be taken from the ejected-sheet stack section 4 with the first page on the front, thereby allowing an operator to go without re-sorting the sheets in a page order.

Figure 2:
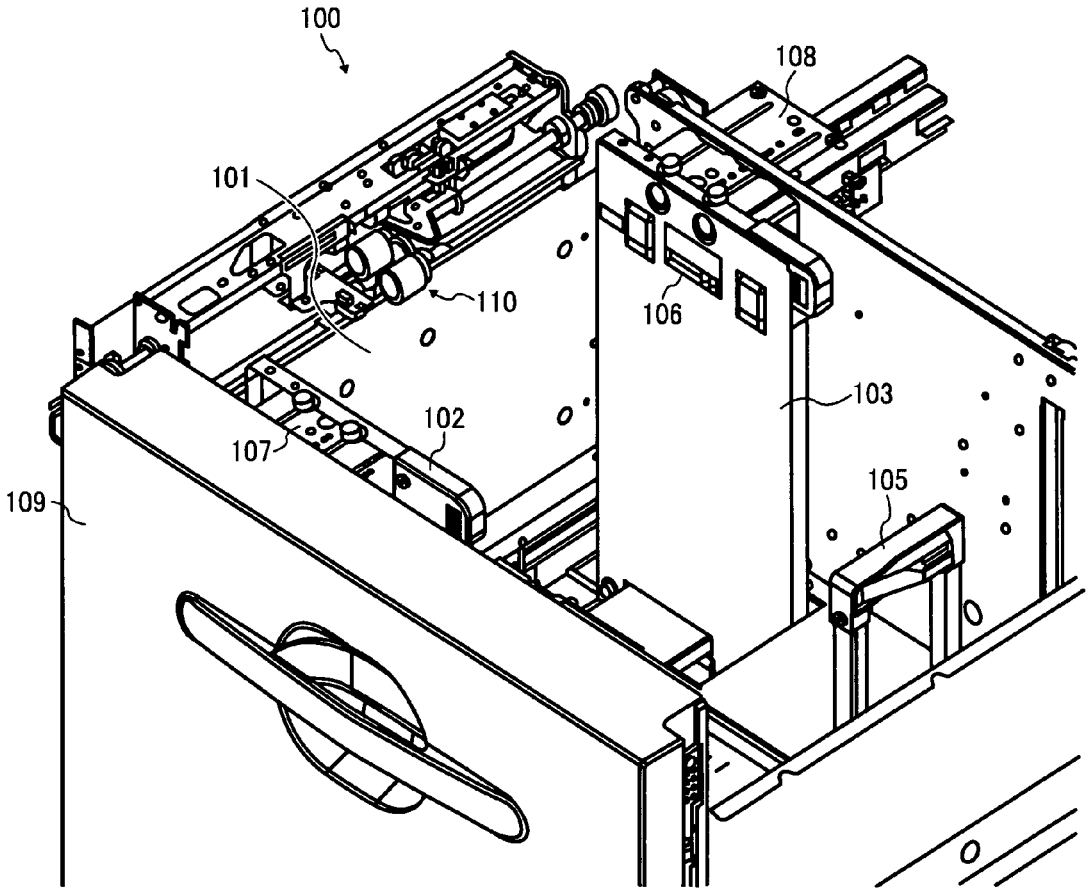
FIG. 2 is a partial perspective view of a large-capacity sheet-feed device according to an example embodiment of the present invention.

At the right side of the image forming apparatus 10 may be mounted a large-capacity sheet-feed device 100 illustrated in FIG. 2. A sheet fed from the large-capacity sheet-feed device 100 is conveyed via conveying rollers 27 provided within the image forming apparatus 10.

FIG. 2 is a partial perspective view of the large-capacity sheet-feed device 100 according to an example embodiment of the present invention.

Figure 3:
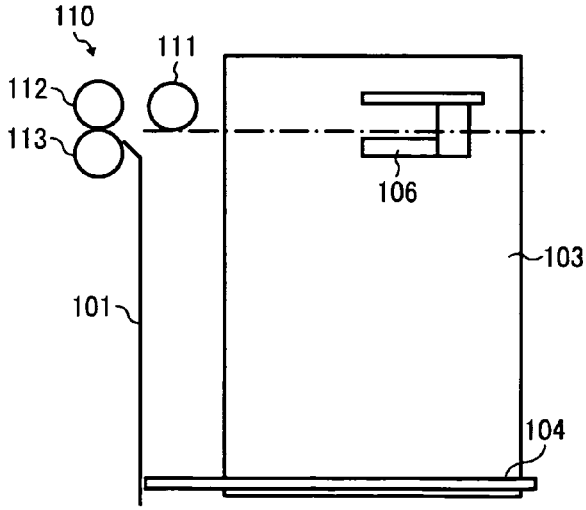
FIG. 3 is a sectional view of the large-capacity sheet-feed device of FIG. 2.

FIG. 3 is a sectional view illustrating a schematic structure of the large-capacity sheet-feed device 100.

As illustrated in FIGS. 2 and 3, the large-capacity sheet-feed device 100 according to this example embodiment includes a front-end guide 101, a first side fence 102, a second side fence 103, a bottom plate 104, a rear-end guide 105, and a sheet-feed separation unit 110. Sheets are stored on a sheet storage portion on the bottom plate 104. The sheet storage portion is defined by being surrounded with the front-end guide 101, the first and second side fences 102 and 103, and the rear-end guide 105. The bottom plate 104 is movable up and down through an elevation mechanism. The large-capacity sheet-feed device 100 also includes a sheet press member to press the sheet.

The sheet-feed separation unit 110 according to this example embodiment employs an FRR (feed and reverse rollers) system including a pickup cam roller 111, a feed cam roller 112, and a reverse cam roller 113. The rotation of these rollers is started at respective preset sheet-feed timings. The pickup cam roller 111, serving as a pickup unit, is capable of contacting with and detaching from the upper surface of a sheet by a driving unit such as a solenoid.

The sheet-feed separation unit 110 includes a sensor capable of detecting the top position of a stack of sheets. The upper limit position of sheets in the sheet-feed separation unit 110 can be previously set. The top position of the stack of sheets is detected by the sensor. By moving the bottom plate 104 (or the elevation mechanism thereof) with a motor, a sheet feed position of the sheet-feed separation unit 110 is controlled so as not to vary even if the number of stored sheets is relatively reduced. Thus, to maintain conditions for such sheet-feed separation constant, the upper limit position of the sheets is adjusted so as to maintain the sheet-feed position constant even if the number of stored sheets varies.

An actuator for operating the sensor is connected to both the pickup cam roller 111 and the feed cam roller 112. The sensor is actuated when a filler attached to an end portion of the actuator blocks the light emitted from the sensor. With this sensor, the position of the upper surface of a sheet is detected to maintain the position of the pickup cam roller 111 constant. Thus, even when the bottom plate 104 is raised due to sheet consumption, the position of the bottom plate 104 is detected through the actuator.

On a sheet feed tray 109 are mounted the front-end guide 101, the first and second side fences 102 and 103, the bottom plate 104, and the rear-end guide 105. The sheet feed tray 109 is detachably inserted in the large-capacity sheet-feed device 100. The sheet feed tray 19 can be drawn from the large-capacity sheet-feed device 100 to load sheets.

On the first and second side fences 102 and 103 are mounted blower fans 107 and 108, respectively. In the inner side faces of the first and second side fences 102 and 103 are provided nozzle-shaped air-blowing ports 106. Although only one of the air-blowing ports 106 is illustrated in the second side fence 103 of FIG. 2, another one of the air-blowing ports 106 is also provided in the first side fence 102. As the blower fans 107 and 108 are started to operate, air is blown from the air-blowing ports 106 of both sides against a lateral side face of a stack of sheets. Such air blow assists the separating function of the sheet-feed separation unit 110, thereby facilitating the separation between the sheets. Each air-blowing port 106 is disposed such that its upper end is lower than the sheet feed position (more specifically, the position of the upper face of a sheet at the sheet-feed position, which is indicated by a dash-and-dot line of FIG. 3).

The large-capacity sheet-feed device 100 according to this example embodiment is of the FRR separation type as described above, and preliminarily spaces apart the sheets by blowing air from the air-blowing ports 106 before starting the separating operation. Thus, by reducing the adhesion force between sheets, the large-capacity sheet-feed device 100 facilitates the separating operation of the sheet-feed separation unit 110, thereby enhancing the sheet-feed separation performance and sheet conveyance quality.

Since each air-blowing port 106 is disposed at a position lower than the sheet-feed position, the air from each air-blowing port 106 is not directly blown against a sheet in feed (or the uppermost sheet picked up by the sheet-feed separation unit 110). Accordingly, the function of the blower fan is limited to the separation between sheets. Thus, the blown air does not reach to the sheet in feed, thereby preventing the sheet in feed from inadvertently floating.

Figure 4:
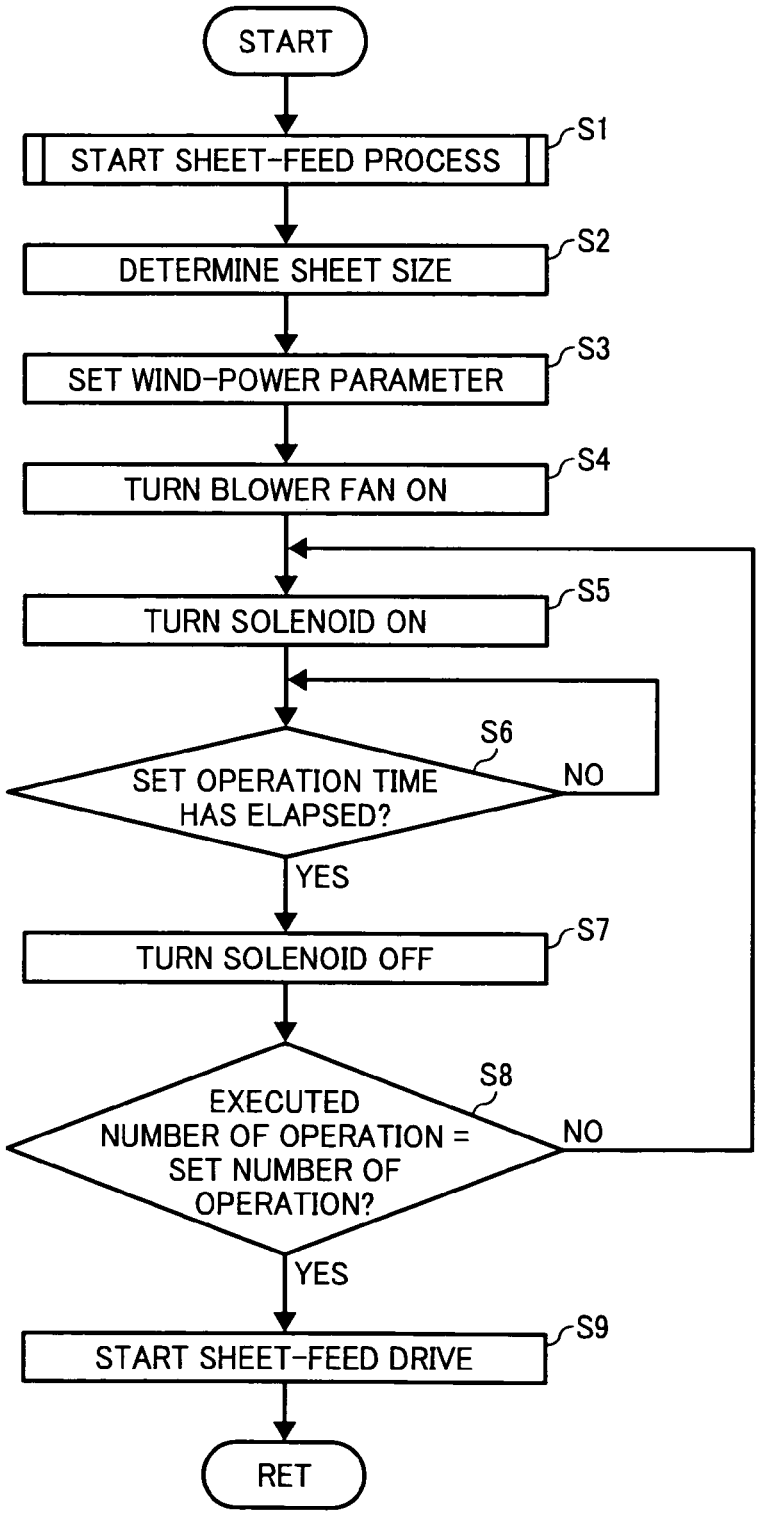
FIG. 4 is a flowchart illustrating an example of sheet feed control.

FIG. 4 illustrates an example of sheet-feed control.

As illustrated in FIG. 4, at S1 a sheet-feed process is started.

At S2, sheet size is determined, and at S3 a wind-power parameter is set.

At S4, the blower fans 107 and 108 are started to drive, and at S5 a solenoid is turned on to move the pickup cam roller 111 to the sheet-feed position.

At S6, it is determined whether a set length of time has elapsed.

If the set length of time has elapsed ("YES" at S7), at S7 the solenoid is turned off.

At S8, it is determined whether the pickup cam roller 111 has contacted with and detached from the sheets for a set number of times or length of time (although only the case with the set number of times is only illustrated in the FIG. 4).

If the pickup cam roller 111 has not contacted with and detached from the sheets for the set number of times or length of time ("NO" at S8), the operations of S5 through S7 are repeated until the pickup cam roller 111 has contacted with and detached from the sheets for the set number of times or length of time.

If the pickup cam roller 111 has contacted with and detached from the sheets for the set number of times or length of time ("YES" at S8), at S9 the sheet feed drive, i.e., the rotation of the feed cam roller 112 and the reverse cam roller 113 is started to separate and feed the sheets.

Figures 5, 5A:
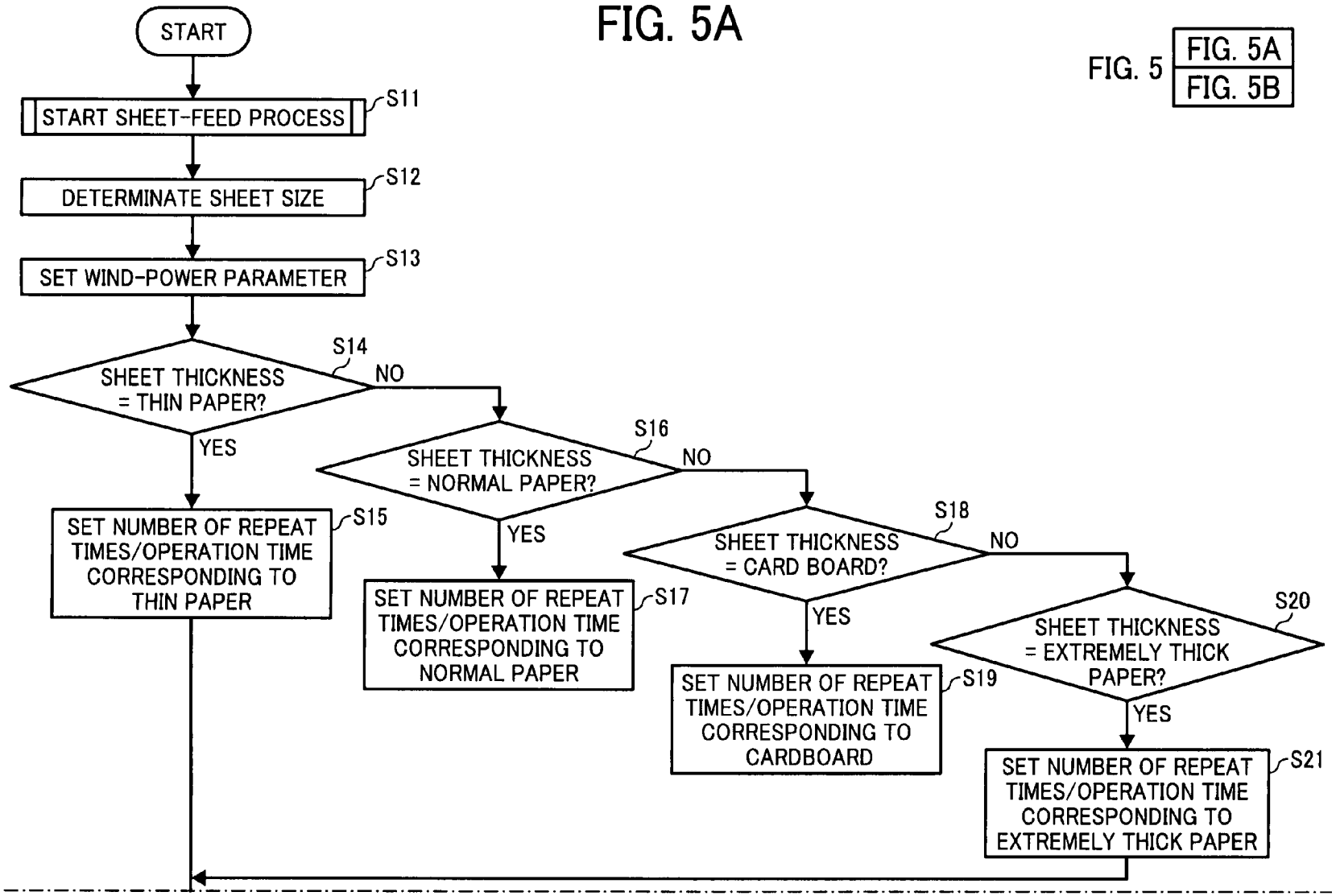
FIGS. 5A and 5B are a flowchart illustrating an example of sheet feed control executed in accordance with sheet thickness.
Figure 5B:
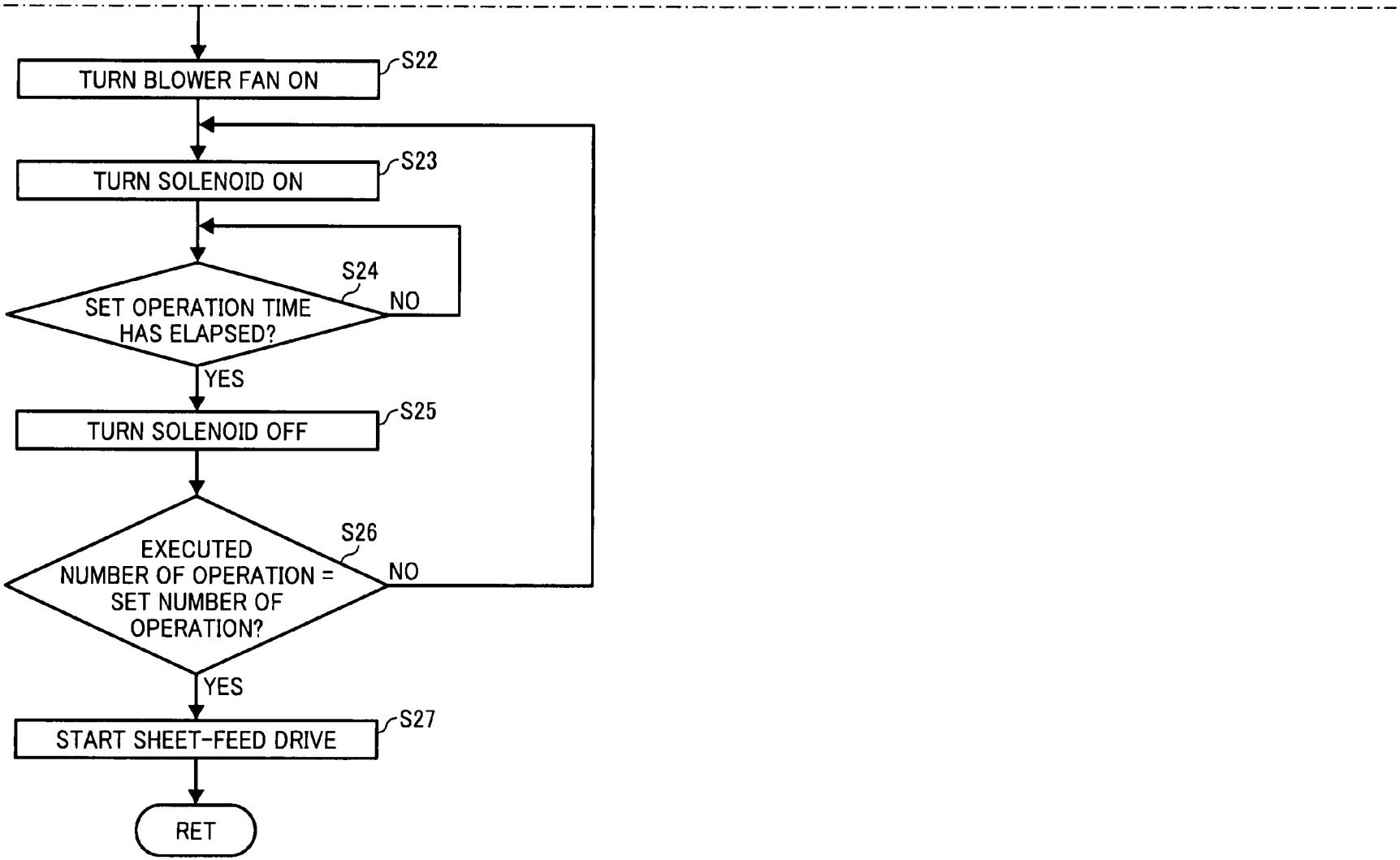

FIGS. 5A and 5B illustrate an example of sheet feed control executed in accordance with sheet thickness. In this case, a sheet thickness detector may be provided to detect the thickness of sheets. Alternatively, the thickness of sheets may be specified by an operator through an operation panel.

As illustrated in FIG. 5A, at S11 a sheet-feed process using the large-capacity sheet-feed device 100 is started.

At S12, sheet size is determined, and at S13 a wind parameter is set.

At S14, S16, S18, and S20, sheet thickness is determined.

At S15, S17, S19, and S21, a number of times or length of time that the pickup cam roller 111 contacts with and detaches from the sheets is set in accordance with the determined sheet thickness.

As illustrated in FIG. 5A, the sheet thickness may be selected from, for example, four levels of "thin paper", "normal paper", "cardboard", and "extremely thick paper". In such case, the number of times or length of time that the pickup cam roller 111 contacts with and detaches from the sheets may also be selected from four levels corresponding to the four levels of the sheet thickness.

At S22, the blower fans 107 and 108 are started to drive.

At S23, the solenoid is turned on to move the pickup cam roller 111 to the sheet-feed position.

At S24, it is determined whether the set length of time has elapsed.

If the set length of time has elapsed ("YES" at S24), at S25 the solenoid is turned off.

At S26, it is determined whether the pickup cam roller 111 has contacted with and detached from the sheets for the set number of times or length of time (although only the case with the set number of times is illustrated in the FIG. 5B).

If the pickup cam roller 111 has not contacted with and detached from the sheets for the set number of times or length of time ("NO" at S26), the operations of S5 thorough S7 are repeated until the pickup cam roller 111 has contacted with and detached from the sheets for the set number of times or length of time.

If the pickup cam roller 111 has contacted with and detached from the sheets for the set number of times or length of time ("YES" at S26), at S27 the sheet-feed drive, i.e., the rotation of the feed cam roller 112 and the reverse cam roller 113 is started to separate and feed the sheets.

Figures 6, 6A:
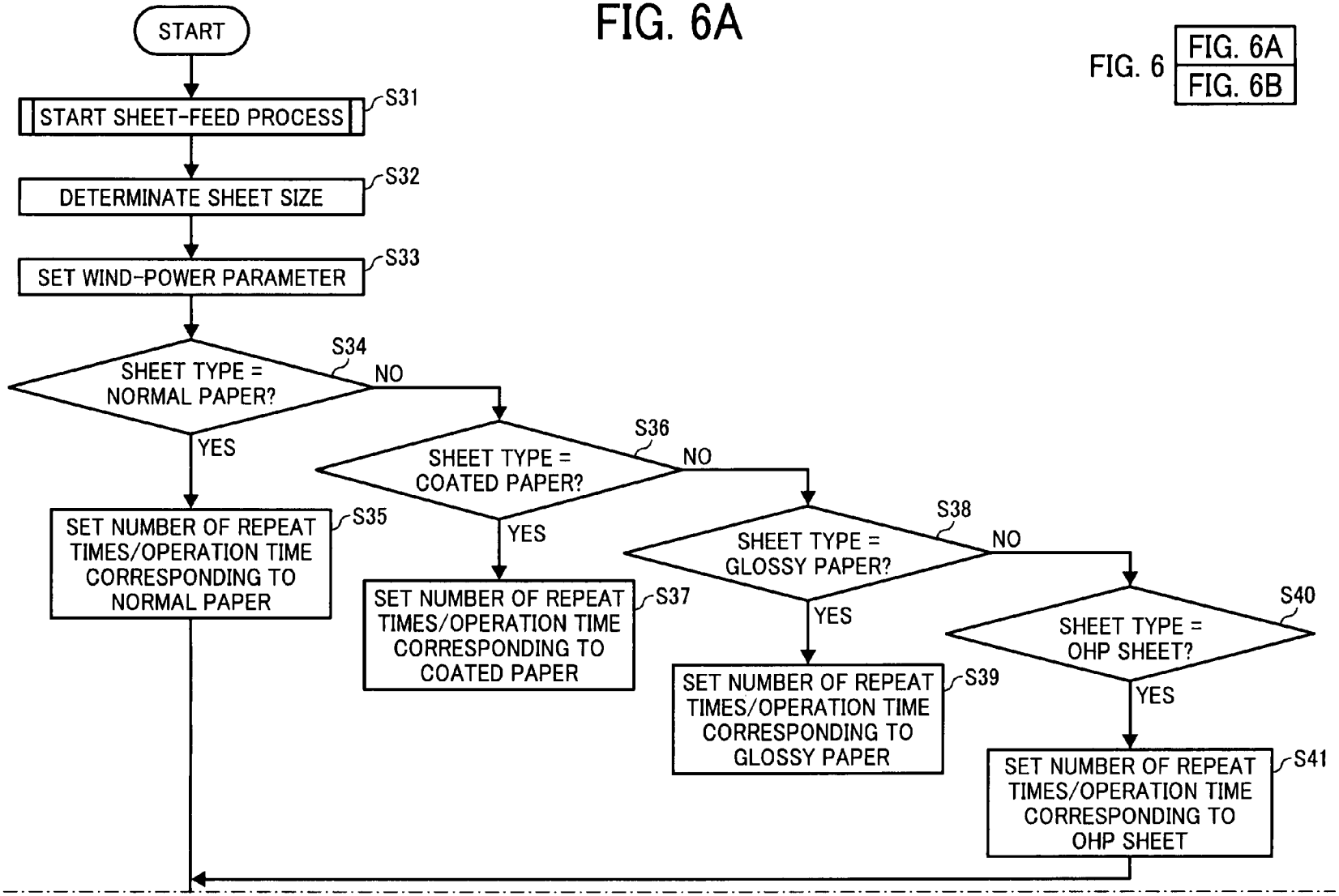
FIGS. 6A and 6B are a flowchart illustrating an example of sheet feed control executed in accordance with sheet type.
Figure 6B:
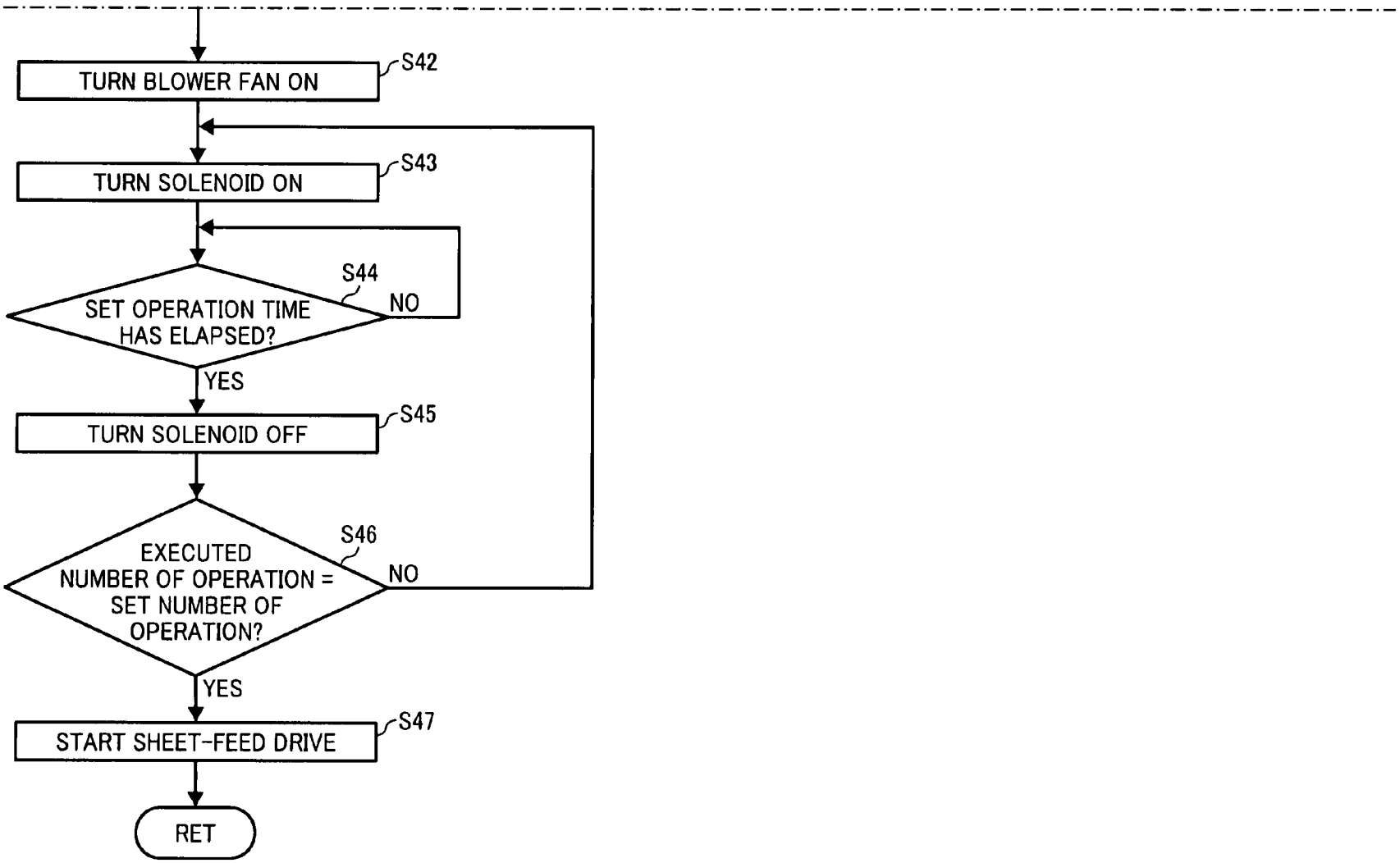

FIGS. 6A and 6B illustrate an example of sheet-feed control executed in accordance with sheet type.

The sheet feed control illustrated in FIGS. 6A and 6B is different from the sheet feed control illustrated in FIGS. 5A and 5B, which is executed in accordance with sheet thickness, in that at S34, S36, S38, and S40 the type of sheets is determined, and at S35, S37, S39, and S41 a number of times or length of time that the pickup cam roller 111 contacts with and detaches from the sheets is set in accordance with the determined sheet type. As illustrated in FIG. 6A, the sheet type may be selected from, for example, four levels of "normal paper", "coated paper", "glossy paper", and "OHP sheet". In such case, the number of times or length of time that the pickup cam roller 111 contacts with and detaches from the sheets may also be selected from four levels corresponding to the four levels of the sheet type. The steps of FIGS. 6A and 6B other than the above-described steps are the same as the corresponding steps of FIGS. 5A and 5B. The sheet type may be set by an operator through the operation panel. Alternatively, a detector may by provided to detect the sheet type.

Figures 7, 7A:
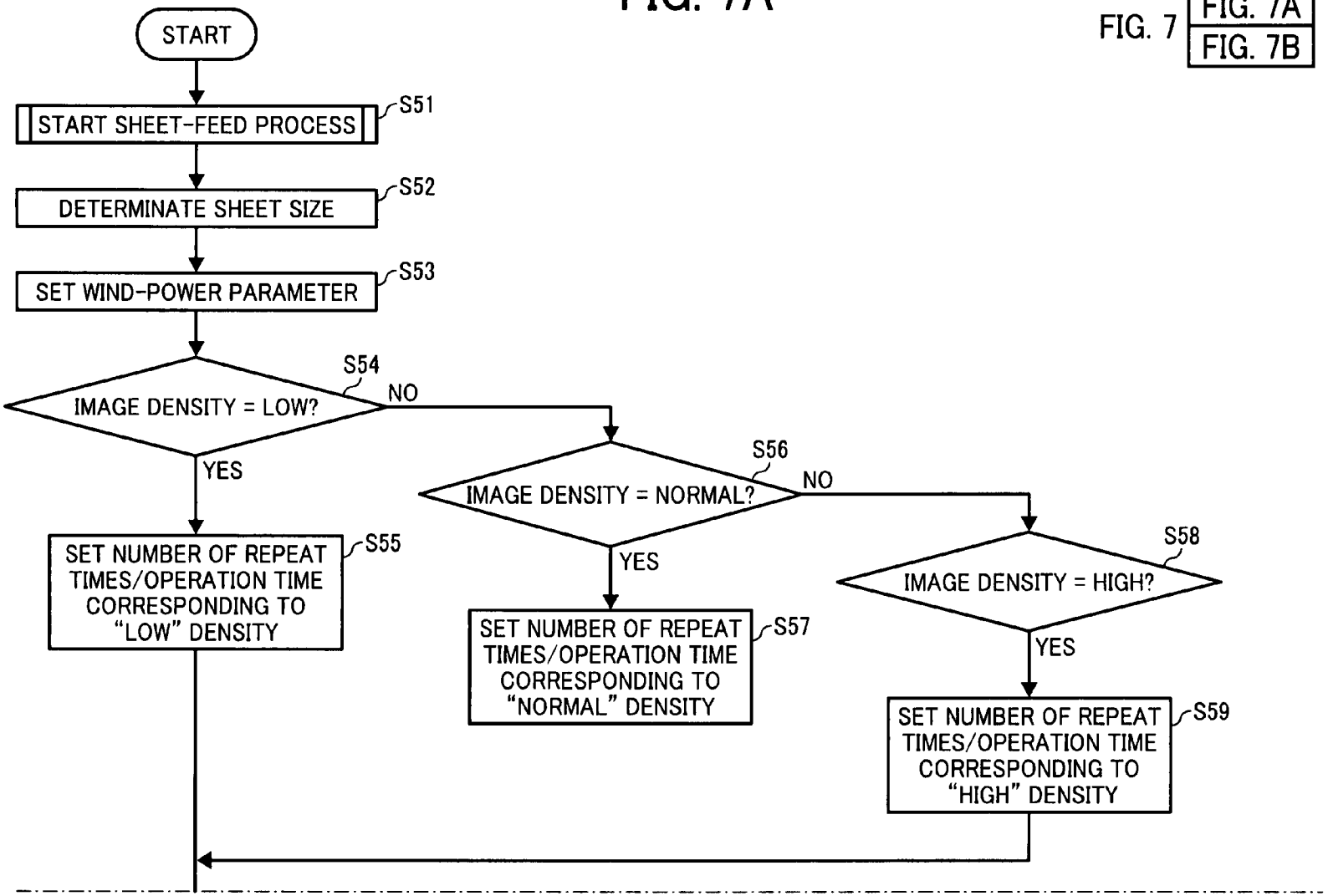
FIGS. 7A and 7B are a flowchart illustrating an example of sheet feed control executed in accordance with density of an image on a preprinted sheet.
Figure 7B:
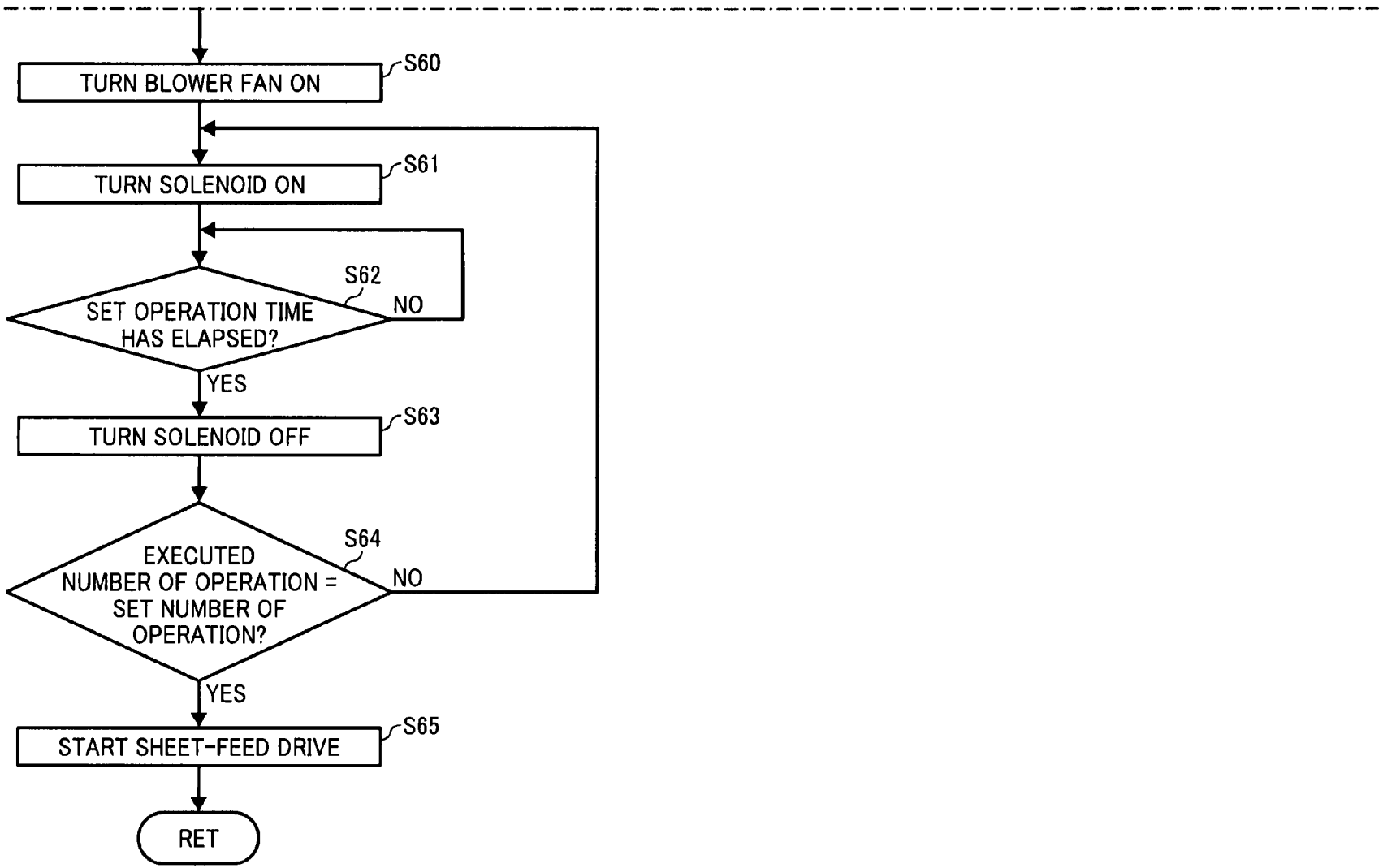

FIGS. 7A and 7B illustrate an example of sheet-feed control executed in accordance with density of an image formed on a preprinted sheet. In such case, an operator may judge the image density on the preprinted sheet output from the image forming apparatus and input a state of the image density through the operation panel. Alternatively, the density of the image may be automatically determined by an image density detector.

The sheet feed control of FIGS. 7A and 7B is different from the sheet feed control of FIGS. 5A and 5B, executed in accordance with sheet thickness, in that at S54, S56, and S58, sheet type is determined, and at S55, S57, and S59 a number of times or length of time that the pickup cam roller 111 contacts with and detaches from the sheets is set in accordance with the determined sheet type. As illustrated in FIG. 7A, the image density may be selected from, for example, three levels of "low", "normal", and "high". In such case, the number of times or length of time that the pickup cam roller 111 contacts with and detaches from the sheets may also be selected from three levels corresponding to the three levels of the image density. The steps other than the above-described steps of FIGS. 7A and 7B are the same as the corresponding steps of FIGS. 5A and 5B.

Figure 8A:
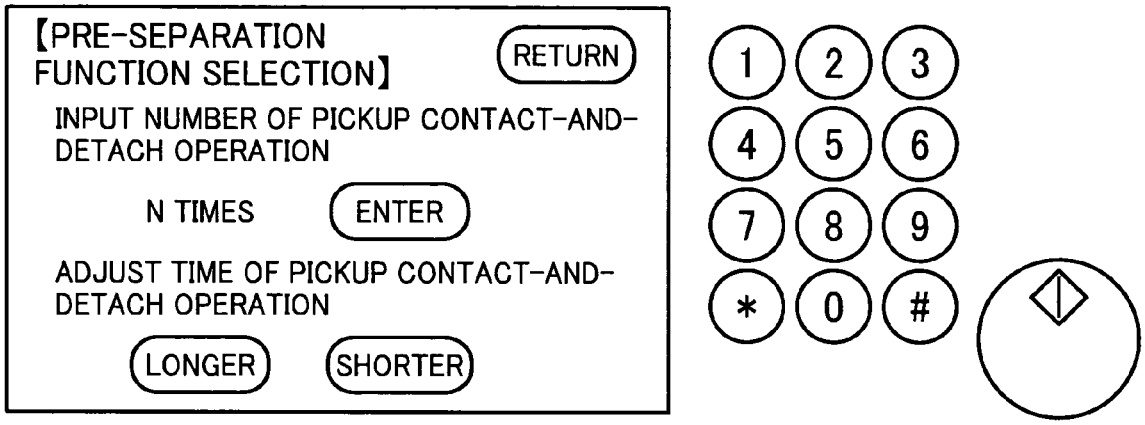
FIGS. 8A to 8D are plan views illustrating examples of screen displays of an operation unit for setting various conditions.
Figure 8B:
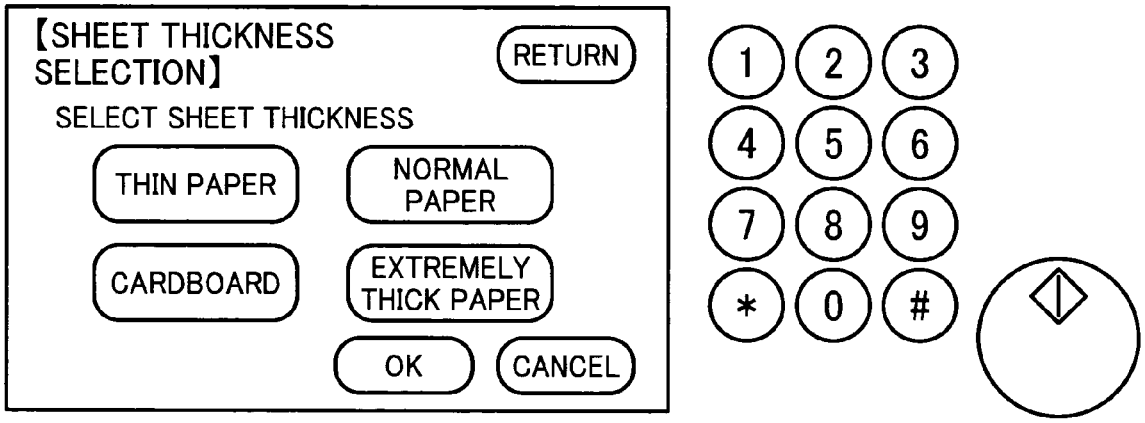
Figure 8C:
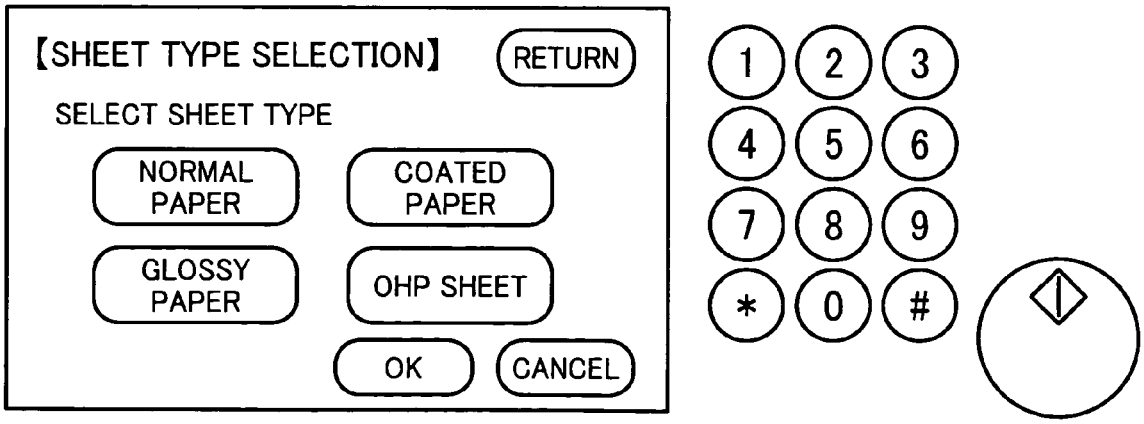
Figure 8D:
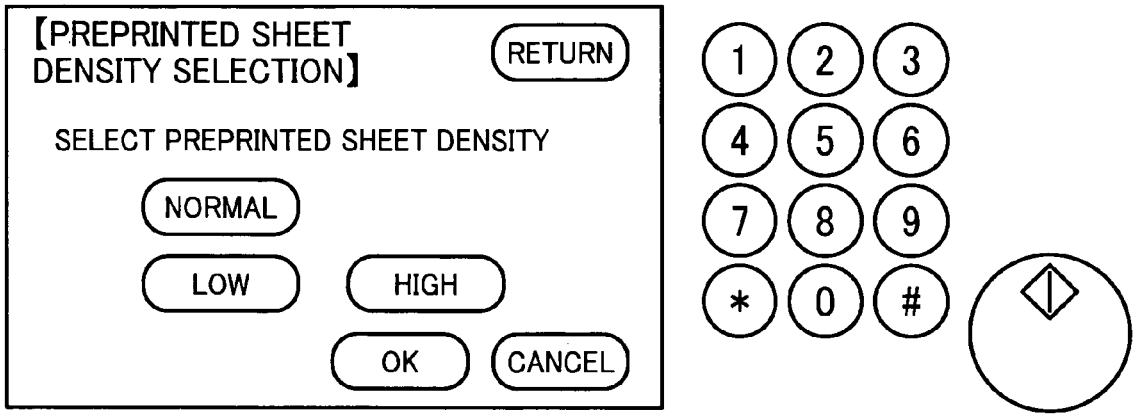

FIGS. 8A to 8D illustrate examples of screen displays used to set various conditions through the operation panel of the image forming apparatus 10. FIG. 8A illustrates an example of a screen display used to set a number of times or length of time that the pickup cam roller 111 contacts with and detaches from the sheets. FIG. 8B illustrates an example of a screen display used to select the sheet thickness. FIG. 8C illustrates an example of a screen display used to select the sheet type. FIG. 8D illustrates an example of a screen display used to select the density of an image formed on a preprinted sheet. As described above, the conditions illustrated in FIGS. 8B to 8D may also be automatically set by the above-described detectors.

Figure 9:
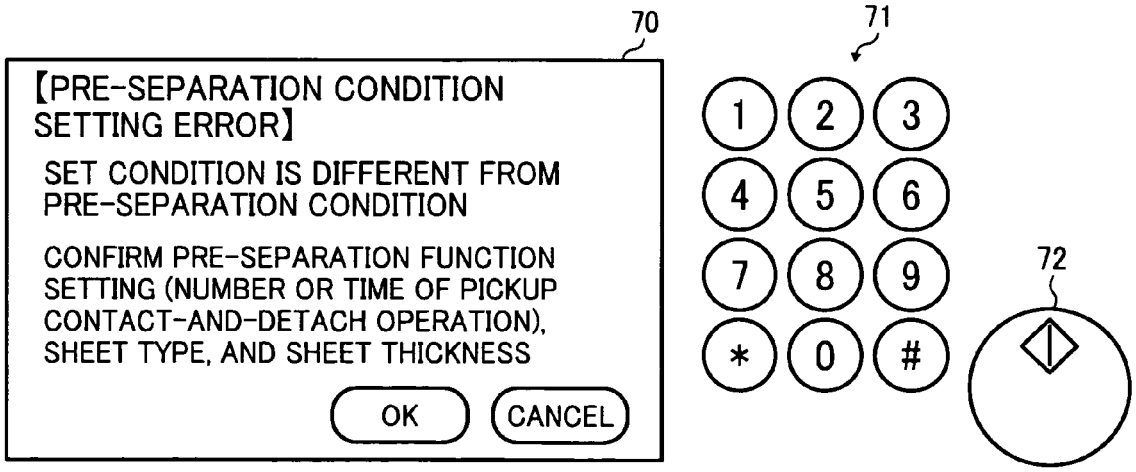
FIG. 9 is a plan view illustrating an example of a screen display indicating an error in setting various conditions.

FIG. 9 illustrates an example of a screen display informing an operator of an error in setting various conditions. On a screen display 70 of the operation unit is displayed a message for prompting the operator to confirm the set conditions since the set conditions are different from the predetermined conditions. As illustrated in FIG. 9, a ten-key 71 and an enter-key 72 may be provided to the operation unit.

Tables 1 to 3, described below, illustrate examples of settings for control parameters on various conditions. Table 1 illustrates examples of control parameters set corresponding to sheet thickness. Table 2 illustrates examples of control parameters set corresponding to sheet type. Table 3 illustrates examples of control parameters set corresponding to the density of an image on a preprinted sheet.

TABLE 1

| | Default | |
|---|---|---|
| Sheet thickness | Number of times of contact-and-detach operations | Length of time of contact-and-detach operations |
| Thin paper | 1 + n1 | 50*t1 |
| Normal paper | 1 + n2 | 100*t2 |
| Cardboard | 1 + n3 | 200*t3 |
| Extremely thick paper | 1 + n4 | 400*t4 |

n: any given integer, t: correction coefficient

TABLE 2

| | Default | |
|---|---|---|
| Sheet type | Number of times of contact-and-detach operations | Length of time of contact-and-detach operations |
| Normal paper | 1 + n5 | 100*t5 |
| Coated paper | 1 + n6 | 50*t6 |
| Glossy paper | 1 + n7 | 50*t7 |
| OHP sheet | 1 + n8 | 200*t8 |

n: any given integer, t: correction coefficient

TABLE 3

| | Default | |
|---|---|---|
| Image density | Number of times of contact-and-detach operations | Length of time of contact-and-detach operations |
| Low | 1 + n9 | 50*t9 |
| Normal | 1 + n10 | 100*t10 |
| High | 1 + n11 | 200*t11 |

n: any given integer, t: correction coefficient

For the sheet thickness, Table 1 indicates that, as the sheet thickness is increased, the number of times or length of time that the pickup cam roller 111 contacts with and detaches from the sheets is set larger or longer. For the sheet type, Table 2 indicates that, as sheet glossiness or smoothness is increased, the number of times or length of time that the pickup cam roller 111 contacts with and detaches from the sheets is set larger or longer. For the image density, Table 3 indicates that, as the image density of a preprinted sheet is increased, the number of times or length of time that the pickup cam roller 111 contacts with and detaches from the sheets is set larger or longer.

As described above, according to an example embodiment of the invention, the sheet pick-up unit (e.g., the pickup cam roller 111) contacts with and detaches from sheets before the sheet-feed separation unit starts to operate and while the blower fans blow air to separate the sheets from each other. As a result, the sheet-feed separation unit can feed the sheets when the adhesion force between the sheets is reduced, thereby enhancing sheet-feed separation performance and sheet conveying quality. Thus, the sheet feed device can provide excellent sheet-feed separation performance and sheet conveyance quality while maintaining low noise and saving consumption power. Further, the downtime of the image forming apparatus due to a sheet-feed error can also be reduced.

Preferably, the image forming apparatus 10 is capable of adjusting a length of time that the pickup cam roller 111 contacts with and detaches from sheets to pick up the sheets. Such length of time may be adjusted through the operation unit or any other suitable unit of the image forming apparatus.

Further, a detector may be provided to detect a number of sheets remaining in a sheet feed tray. For example, a sheet feed device according to an example embodiment may be configured that, when one sheet remains in the sheet feed tray, the blower fans are stopped and the pickup cam roller 111 performs the contact-and-detach operations only once.

A tray-mount detector may be provided to detect that the sheet feed tray is mounted to the image forming apparatus. In such case, if the tray-mount detector detects that the sheet feed tray is mounted to the image forming apparatus, various conditions as described above may be reset.

Although in the above description example embodiments are described with reference to drawings, the invention is not limited to the above-described example embodiments. For example, the sheet feed device according to an example embodiment is not limited to the large-capacity sheet-feed device described above, but may be a normal sheet cassette or sheet tray, for example. In such case, it may be preferable that a number of times or length of time that the pickup cam roller 111 contacts with and detaches from sheets is adjustable for each sheet feed tray.

The large-capacity sheet-feed device described above need not be necessarily mounted on a lateral side face of the image forming apparatus but may be disposed on a lower portion of the image forming apparatus. The separation system is not limited to the FRR type illustrated in FIGS. 2 and 3 but may be any other suitable separation system.

Any suitable values may be set for the above-described control parameters, and any suitable number of levels may be configured to be selectable on various conditions.

Further, any suitable configuration may be employed for each component of the image forming apparatus. For example, the invention may be applicable to a multi-color image forming apparatus using two color toners or a full-color image forming apparatus using four color toners, as well as a monochromatic apparatus. The image forming apparatus is not limited to the copying machine described above but may be a printer, a facsimile machine, and a multi-functional device combining several of the foregoing capabilities.

Example embodiments being thus described, it should be apparent to one skilled in the art after reading this disclosure that the examples and embodiments may be varied in many ways. Such variations are not to be regarded as a departure from the spirit and scope of the present invention, and such modifications are not excluded from the scope of the following claims.

What is claimed is:

1. An image forming apparatus comprising a sheet feed device, the sheet feed device including:

a sheet storage portion configured to store a stack of sheets;

a pick-up unit configured to pick up the sheets stored in the sheet storage portion;

a sheet-feed separation unit configured to separate and feed one by one the sheets picked up by the pick-up unit; and an air blower configured to blow air against a lateral side face of the stack of sheets stored in the sheet storage portion, the pick-up unit picking up the sheets while the air blower blows air and before the sheet-feed separation unit starts to operate, wherein one of a number of times and a length of time that the pick-up unit picks up while the air blower blows air and before the sheet-feed separation unit starts to operate is adjustable based on a density of an output image.

2. The image forming apparatus according to claim 1, wherein the pick-up unit picks up the sheets by contacting with and detaching from an uppermost sheet of the stack of sheets a plurality of times while the air blower blows air and before the sheet-feed separation unit starts to operate.

3. The image forming apparatus according to claim 1, wherein a length of time that the pick-up unit picks up the sheets is adjustable.

4. The image forming apparatus according to claim 1, further comprising a detector configured to detect a number of sheets remaining in the sheet storage portion, wherein, when the remaining number is one, the air blower stops blowing and the pick-up unit picks up only once.

5. The image forming apparatus according to claim 1, wherein one of a number of times and a length of time that the pick-up unit picks up while the air blower blows air and before the sheet-feed separation unit starts to operate is further adjustable based on a sheet thickness.

6. The image forming apparatus according to claim 5, further comprising a sheet-thickness setting unit configured to set the sheet thickness.

7. The image forming apparatus according to claim 5, further comprising a sheet-thickness detector configured to detect the sheet thickness.

8. The image forming apparatus according to claim 1, wherein one of a number of times and a length of time that the pick-up unit picks up while the air blower blows air and before the sheet-feed separation unit starts to operate is further adjustable based on a sheet type.

9. The image forming apparatus according to claim 8, further comprising a sheet-type setting unit configured to set the sheet type.

10. The image forming apparatus according to claim 8, further comprising a sheet type detector configured to detect the type of the sheets.

11. The image forming apparatus according to claim 1, further comprising an image-density setting unit configured to set the density of the output image.

12. The image forming apparatus according to claim 1, further comprising an image density detector configured to detect the density of the output image.

13. An image forming apparatus comprising a sheet feed device, the sheet feed device including:

a sheet storage portion configured to store a stack of sheets;

a pick-up unit configured to pick up the sheets stored in the sheet storage portion;

a sheet-feed separation unit configured to separate and feed one by one the sheets picked up by the pick-up unit; and an air blower configured to blow air against a lateral side face of the stack of sheets stored in the sheet storage portion, the pick-up unit picking up the sheets while the air blower blows air and before the sheet-feed separation unit starts to operate, wherein the sheet feed device includes a plurality of sheet-feed stages, and one of a number of times and a length of time that the pick-up unit picks up is adjustable for each of the sheet-feed stages.

14. The image forming apparatus according to claim 1, further comprising;

a sheet feed tray detachably mountable in the image forming apparatus, the sheet feed tray including the sheet storage portion; and a tray mount detector configured to detect whether the sheet feed tray is mounted in the image forming apparatus, wherein, when the tray mount detector detects that the sheet feed tray is mounted in the image forming apparatus, one of a number of times and a length of time that the pick-up unit picks up is reset.

15. The image forming apparatus according to claim 13, wherein the pick-up unit picks up the sheets by contacting with and detaching from an uppermost sheet of the stack of sheets a plurality of times while the air blower blows air and before the sheet-feed separation unit starts to operate.

16. The image forming apparatus according to claim 13, wherein a length of time that the pick-up unit picks up the sheets is adjustable.

17. The image forming apparatus according to claim 13, further comprising a detector configured to detect a number of sheets remaining in the sheet storage portion, wherein, when the remaining number is one, the air blower stops blowing and the pick-up unit picks up only once.

18. The image forming apparatus according to claim 1, wherein the image density is selected from three levels.

19. The image forming apparatus according to claim 18, wherein the three levels of the image density is selected from at least one of low, normal, and high.

20. The image forming apparatus according to claim 18, wherein a number of times or a length of time that the pickup unit contacts with and detaches from the sheets is selected from three levels corresponding to the three levels of the image density.

* * * * *